United States Patent [19]

Schultz et al.

[11] Patent Number: 4,962,815

[45] Date of Patent: Oct. 16, 1990

[54] INFLATABLE STRADDLE PACKER

[75] Inventors: Roger L. Schultz, Plano, Tex.; James C. Tucker, Graham, Okla.

[73] Assignee: Halliburton Company, Duncan, Okla.

[21] Appl. No.: 381,624

[22] Filed: Jul. 17, 1989

[51] Int. Cl.[5] ..... E21B 23/06; E21B 33/124

[52] U.S. Cl. ..... 166/387; 166/127; 166/191; 166/240; 166/185

[58] Field of Search ..... 166/127, 183–187, 166/191, 240, 305.1, 386, 387

[56] References Cited

U.S. PATENT DOCUMENTS

| | | | |
|---|---|---|---|
| 4,246,964 | 1/1981 | Brandell | 166/106 |
| 4,296,808 | 10/1981 | Baker et al. | 166/191 |
| 4,566,535 | 1/1986 | Sanford | 166/191 |
| 4,567,944 | 2/1986 | Zunkel et al. | 166/120 |
| 4,569,396 | 2/1986 | Brisco | 166/191 |
| 4,633,952 | 1/1987 | Ringgenberg | 166/336 |
| 4,648,448 | 3/1987 | Sanford et al. | 166/191 |
| 4,768,590 | 9/1988 | Sanford et al. | 166/187 |
| 4,823,882 | 4/1989 | Stokley et al. | 166/387 |
| 4,856,583 | 8/1989 | Greenlee et al. | 166/127 |

OTHER PUBLICATIONS

Exhibit A: Article from *Ocean Industry*, Feb., 1989, pp. 44–45, entitled "Thru-Tubing Straddle Packer Expands, Seals in Casing".

Exhibit B: *Tam International 1980–1981 General Catalog*, portion headed "Inflatable Perforation Wash Tool".

Exhibit C: Advertising brochure of Tam International entitled, "Tam-J TM Inflatable Workover/Testing Packers and Accessories Ordering Guide, Jan., 1986".

Exhibit D: Brochure of Tam International entitled "TAM-J TM Heavy-Duty Inflatable Packers for Well Testing, Workovers, and Production", 1986.

Exhibit E: Lynes 1978–79 Catalog, pages 18, 19, 22 and 23.

*Primary Examiner*—Bruce M. Kisliuk

*Attorney, Agent, or Firm*—James R. Duzan; L. Wayne Beavers

[57] ABSTRACT

A straddle packer apparatus includes a housing having a central opening. The housing has inflation passages, treating fluid passages, and equalizing passages defined therein. Upper and lower longitudinally spaced packers are mounted on the housing on opposite sides of an outlet of the treating fluid passage. An inner mandrel is slidably received in the central opening of the housing. The mandrel has a mandrel bore and has upper and lower inflation ports, upper and lower equalizing ports, and a treating port, all of which communicate with the mandrel bore. A lug and endless J-slot is operably associated with the housing and mandrel for controlling a telescoping position of the mandrel relative to the housing in response to telescoping reciprocation without rotation of the mandrel relative to the housing. The lug and J-slot define an endlessly repeating sequence of inflating position, treating position, equalizing position, and ready position wherein the tool is ready to return to the original inflating position on the next telescoping stroke of the mandrel within the housing.

21 Claims, 10 Drawing Sheets

INFLATABLE STRADDLE PACKER

BACKGROUND OF THE INVENTION

1. Field Of The Invention

The present invention relates generally to straddle packer apparatus for isolating a zone of a well, and more particularly, but not by way of limitation, to straddle packer apparatus capable of being lowered through a production tubing on a coiled tubing, and then inflated to isolate a zone of a production casing for treatment without the need for pulling the production tubing from the well.

2. Description Of The Prior Art

During the life of an oil or gas well, it is often desirable to perform treating operations on some subsurface zone of the well. The cost involved in performing treating operations on completed wells which require the removal of production tubing is often very high. This is especially true when a well is located in a remote area such as the North Slope of Alaska where a drilling rig must be moved back over the well in order to perform work over operations. Many of these wells located on the North Slope of Alaska are equipped with large tubing strings, e.g., three inch or four and one-half inch tubing, production packers and gas lift valves. This high work over cost creates the need for tools which can be run on small diameter coiled tubing and can pass through production tubing and other equipment and then expand out to seal off intervals inside the production casing for treating operations.

The prior art presently includes several straddle packer apparatus which can be utilized in the general manner described above. A first such device is being marketed by Nowsco Well Service Ltd. of Aberdeen, Scotland, as described in an *Ocean Industry* article dated February, 1989, entitled "Thru-Tubing Straddle Packer Expands, Seals in Casing" at pages 44–45. That apparatus is lowered into the well while circulating fluid down through the coiled tubing and out a dump sub. After the tool is located at the appropriate position in the well, the pumping rate down the coiled tubing is increased and the dump sub closes thus directing fluid to the packers to inflate the packers. Weight is then set down on the apparatus to close the inflation ports and open the treating ports. After treatment is completed picking up weight reopens the packer inflation ports and allows the packers to deflate. The tool can then be relocated and recycled to treat another zone.

Another inflatable straddle packer is marketed by Tam International of Houston, Texas, as disclosed in the *Tam International* 1980–1981 *General Catalog* under the heading "Inflatable Perforation Wash Tool". The Tam International inflatable perforation wash tool can be run on coiled tubing. A ball is dropped to seal the mandrel of the tool prior to inflation of the packers. Weight is then set down on the tool to close the inflation ports and open the circulating or treating ports. After treatment, weight is picked up to deflate the packers and unseat the tool.

U.S. Pat. No. 4,648,448 to Sanford et al., and assigned to Tam International, Inc., of Houston, Tex., discloses another straddle packer apparatus. The apparatus disclosed in the '448 patent utilizes a lug and J-slot structure which is actuated by a combination of reciprocation and rotation of a rigid tubing string on which the tool is lowered. When run on a rigid tubing string, so that the tool can be rotated to actuate the J-slot mechanism, it does not appear that this apparatus could be run through production tubing and set in production casing below the production tubing. A Tam International advertising brochure entitled "Tam-J TM Inflatable Workover/Testing Packers And Accessories Ordering Guide" dated January, 1986, indicates at page 5 thereof under the heading "Coil-Tubing Operations" that smaller diameter Tam-J TM packers can be utilized on continuous coil tubing by removing the lugs from the J-slot mechanism and allowing the tool to be set, released and reset with straight up and down movement of the coil tubing. Thus, the J-slot mechanism is in effect eliminated from this straddle packer apparatus when it is utilized with coil tubing, which cannot be rotated.

All of the devices discussed above which are designed to be run on coiled tubing down through production tubing and then set in production casing are limited in their operating flexibility since they only have two operating positions which are achieved by either setting down weight or picking up weight. These tools are run into the well with their inflating ports in an open position, and after being located at the appropriate elevation in the well, the packers are inflated to seal them against the casing. Weight is then set down on the packers to close the inflation ports and open a treating port between the packers. Subsequently, weight is picked up from the apparatus to close the treating ports and reopen the inflation ports thus allowing the packers to deflate.

SUMMARY OF THE INVENTION

The present invention provides an improved straddle packer apparatus designed to be lowered on coil tubing down through production tubing and then set in production casing located below the production tubing.

A lug and endless J-slot mechanism provides more than two different operating positions of the tool in response to simple vertical reciprocation of the coiled tubing without rotation thereof. This is accomplished by mounting either the lug or the J-slot in a rotatable body mounted within the straddle packer apparatus. Thus, a simple reciprocating motion without rotation of the coiled tubing can be translated into a multitude of operating positions of the tool as defined by the pattern of the J-slot.

One particular operating position which has been added to the straddle packer apparatus of the present invention is an equalizing position. In the equalizing position, the sealed zone of the well located between the inflated packers is communicated with the well annulus both above and below the packers so as to equalize pressures across the packers prior to deflating the packers. This makes it much easier to release the packers, and prevents damage to the packers, thus assuring that multiple settings of the straddle packer apparatus can be accomplished.

More particularly, this straddle packer apparatus includes a housing having a central housing opening and having packer inflation passage means defined in the housing. The housing also has a treating fluid passage defined therein, with an outlet of the treating fluid passage extending through a side wall of the housing.

Upper and lower longitudinally spaced packers are mounted on the housing on opposite sides of the outlet of the treating fluid passage. The packers are in communication with the packer inflation passage means of the housing.

The housing also has an equalizing passage means defined therein communicated with an exterior of the housing above the upper packer and communicated with the exterior of the housing below the lower packer.

An inner mandrel is slidably received in the central housing opening. The mandrel has a mandrel bore and has inflation port means, treating port means, and equalizing port means defined therein all of which are communicated with the mandrel bore.

A lug and endless J-slot means is operably associated with the housing and the inner mandrel, for controlling a telescoping position of the mandrel relative to the housing in response to telescoping reciprocation without rotation of the mandrel relative to the housing. The mandrel is movable between an inflating position, a treating position, an equalizing position, and a ready position wherein the mandrel is positioned to return to the inflating position so that the cycle can be repeated any number of times.

The endless J-slot is preferably defined on the mandrel, and the lug which is received in the J-slot is defined on a rotating body mounted in the housing so as to permit relative rotational motion between the lug and the J-slot about a longitudinal axis of the housing without having relative rotational motion between the mandrel and the housing itself.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

In FIGS. 5A–5G, the tool is shown in its treating and ready positions, which are identical with regard to the relative positions of the components of the tool.

In FIGS. 6A–6F the apparatus is shown in its equalizing position.

DETAILED DESCRIPTION OF THE PREFERRED EMBODIMENTS

Figure 1:
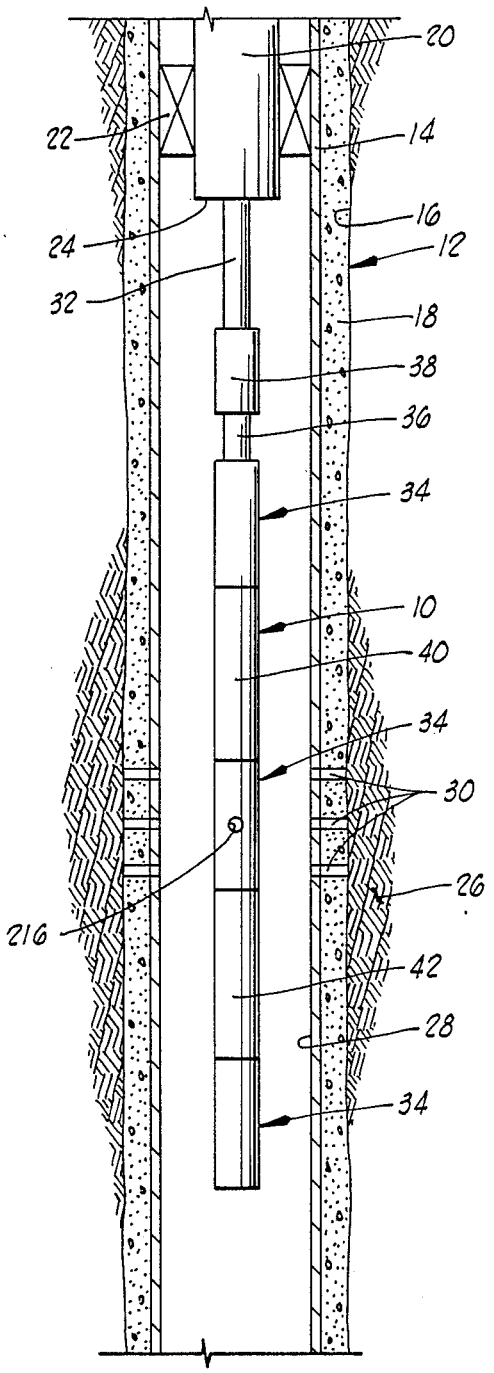
FIG. 1 is a schematic elevation view of the straddle packer apparatus of the present invention being lowered into place adjacent a subsurface zone of a production well. The straddle packer apparatus has been lowered through a production tubing and is located in the production casing below the lower end of the production tubing.
Figure 2:
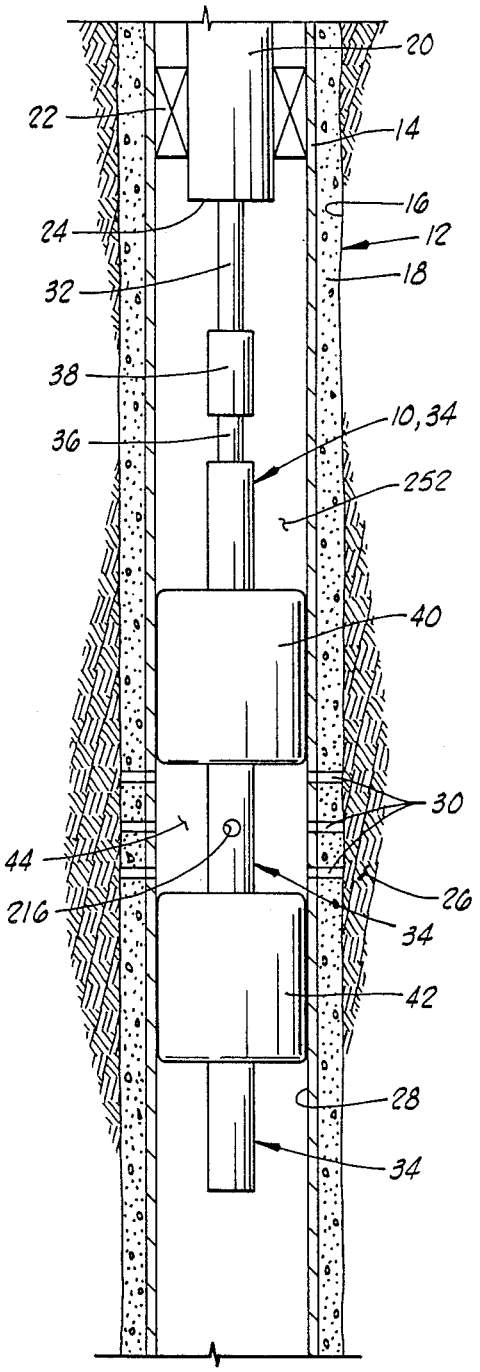
FIG. 2 is a schematic elevation view similar to FIG. 1, showing the packers inflated to isolate the subsurface zone of the well which is to be treated.

Referring now to the drawings, and particularly to FIGS. 1 and 2, the straddle packer apparatus is thereshown in a schematic elevation view in place in a well. The straddle packer apparatus is generally designated by the numeral 10. The packer 10 is shown in FIG. 1 after it has been lowered into a well generally designated by the numeral 12. The well 12 includes a production casing 14 cemented in place within a bore hole 16 by cement 18. A production tubing 20 is located within the casing 14 and has a packer 22 sealing the annulus between production tubing 20 and production casing 14. The production tubing has a lower end 24. As is apparent in FIG. 1, the production casing 14 extends downward below the lower end 24 of production tubing 20. The well 12 intersects a subsurface formation 26, and an interior 28 of production casing 14 is communicated with the formation 26 through a plurality of perforations 30.

In FIG. 1, the straddle packer apparatus 10 has been lowered on a length of coiled tubing 32 into position adjacent the subsurface formation 26. The "coiled tubing" 32 is a relatively flexible tubing having a diameter on the order of one and one-half inches which can be coiled on a large reel and brought to the well site, where it is uncoiled to lower tools into the well without the use of a drilling rig. Although not illustrated in FIGS. 1 and 2, a tubing fill-up valve may be run on the coiled tubing string 32 to allow the tubing string 32 to fill up as it is lowered into the well.

The straddle packer apparatus 10 includes a housing generally designated by the numeral 34, with an inner mandrel 36 slidably received in the housing. A releasable connecting means 38 connects the upper end of the mandrel 36, and thus connects the housing 34, to the coiled tubing 32 and communicates the inner bore of the coiled tubing 32 with the interiors of the mandrel 36 and the housing 34.

Figures 3A, 3B, 3C:
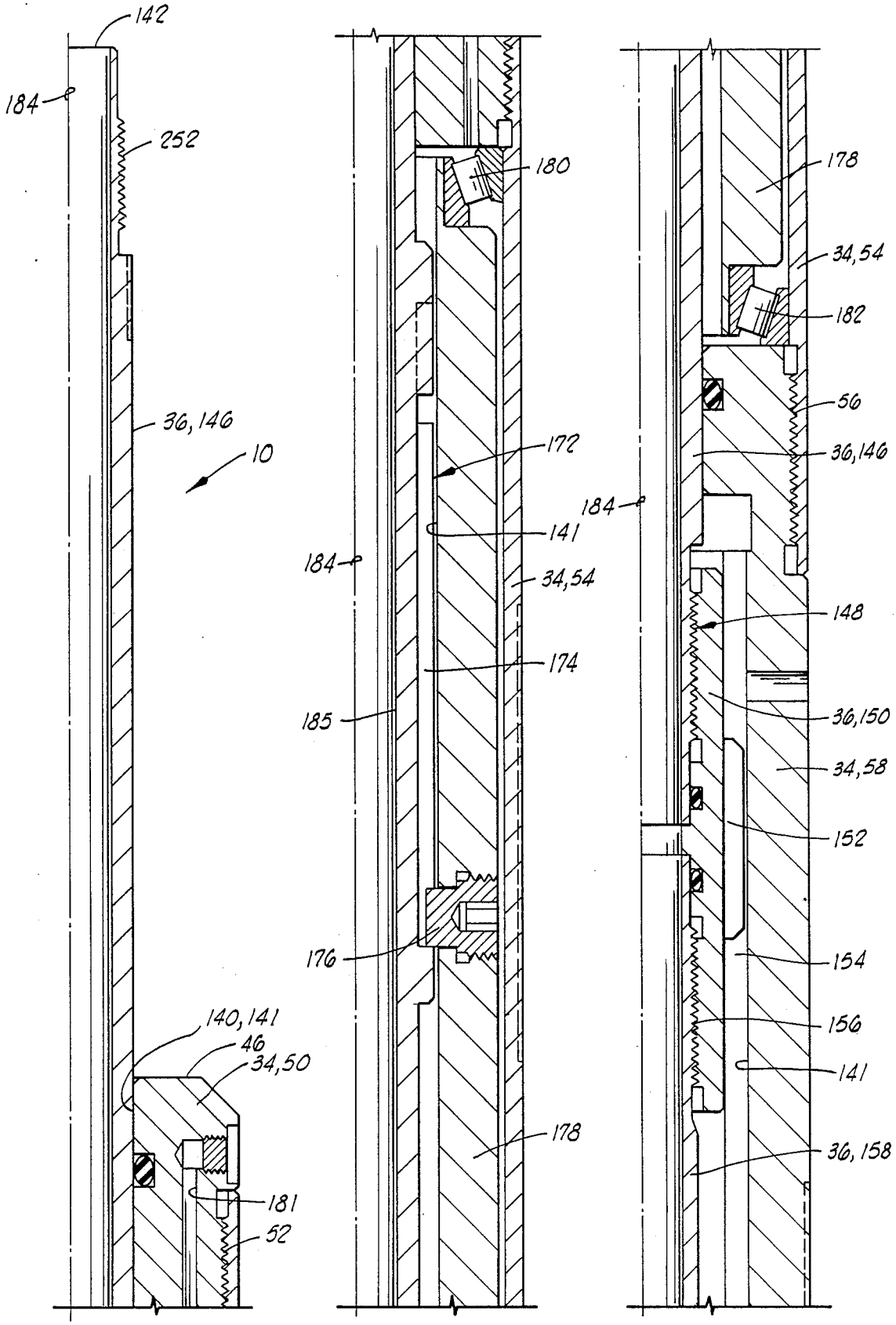
FIGS. 3A–3L comprise an elevation right side only sectioned view of the straddle packer apparatus of the present invention. The apparatus is in an inflating position, but the packers have not yet been inflated.
Figures 3D, 3E, 3F:
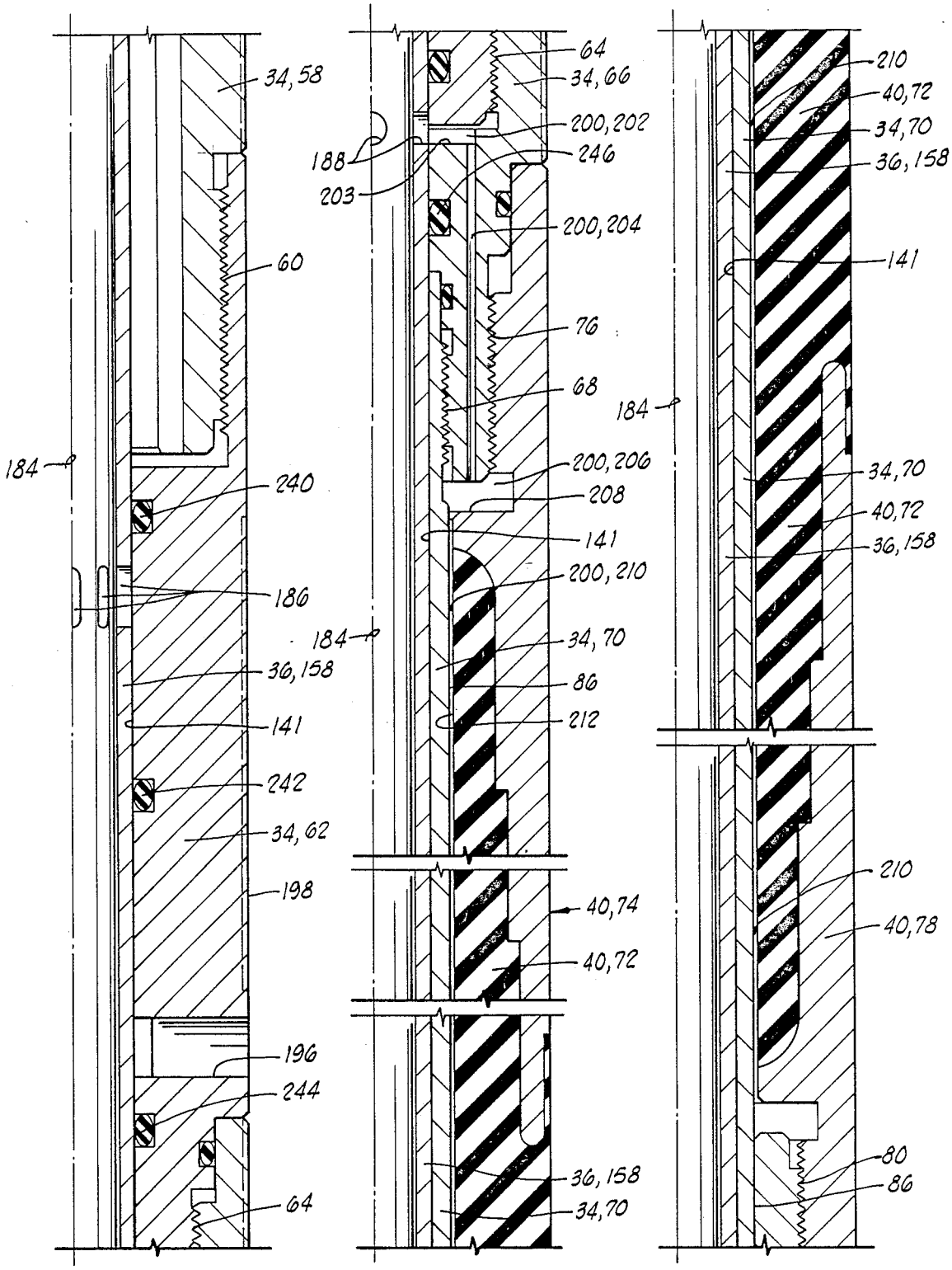
Figure 3G:
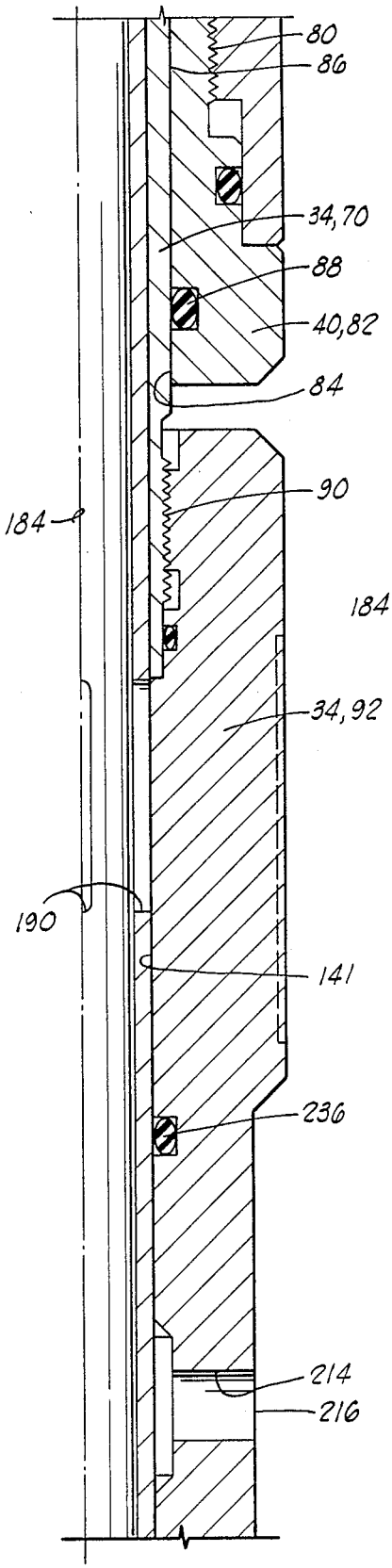
Figure 3H:
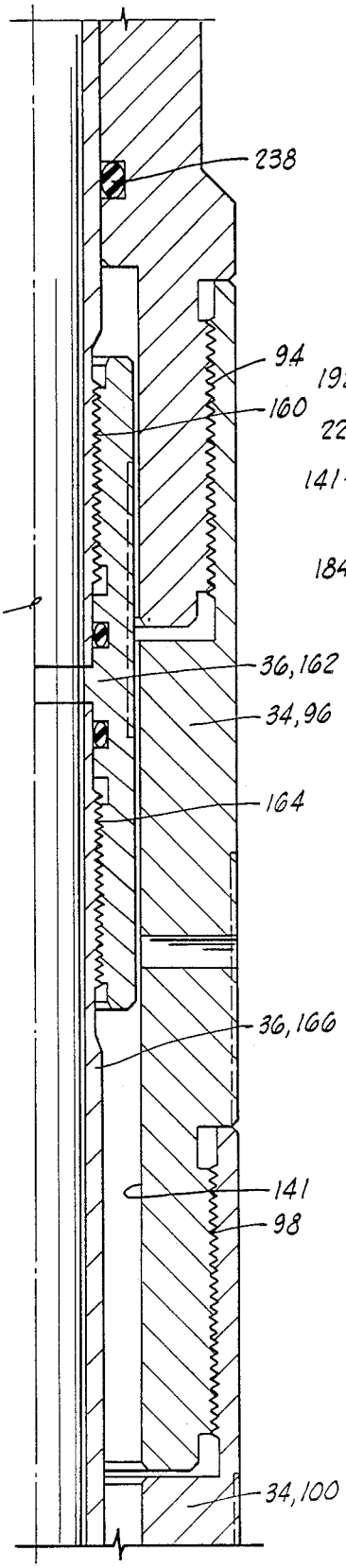
Figure 3I:
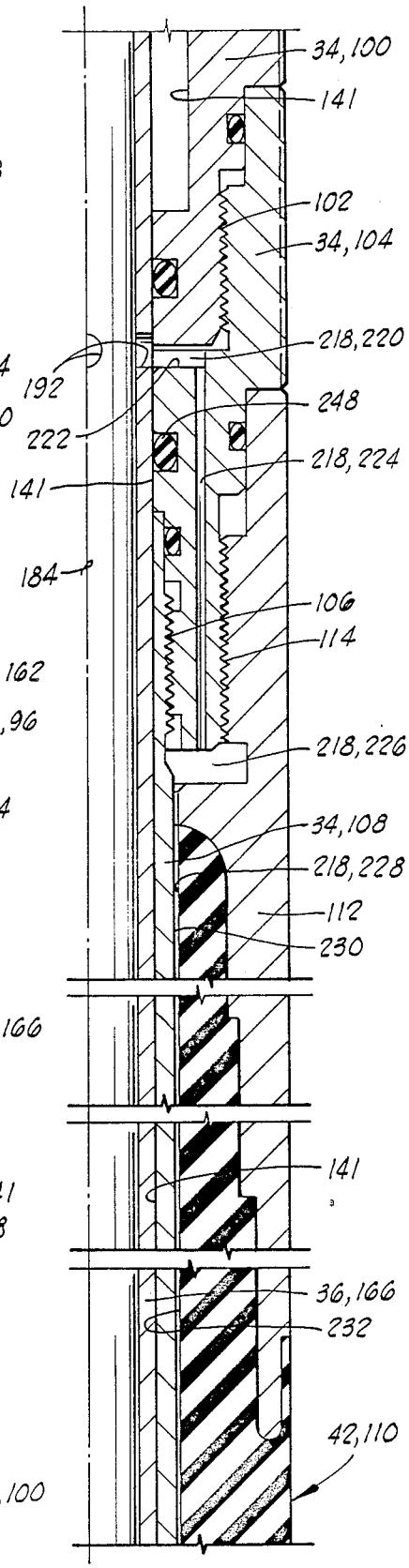
Figures 3J, 3K, 3L:
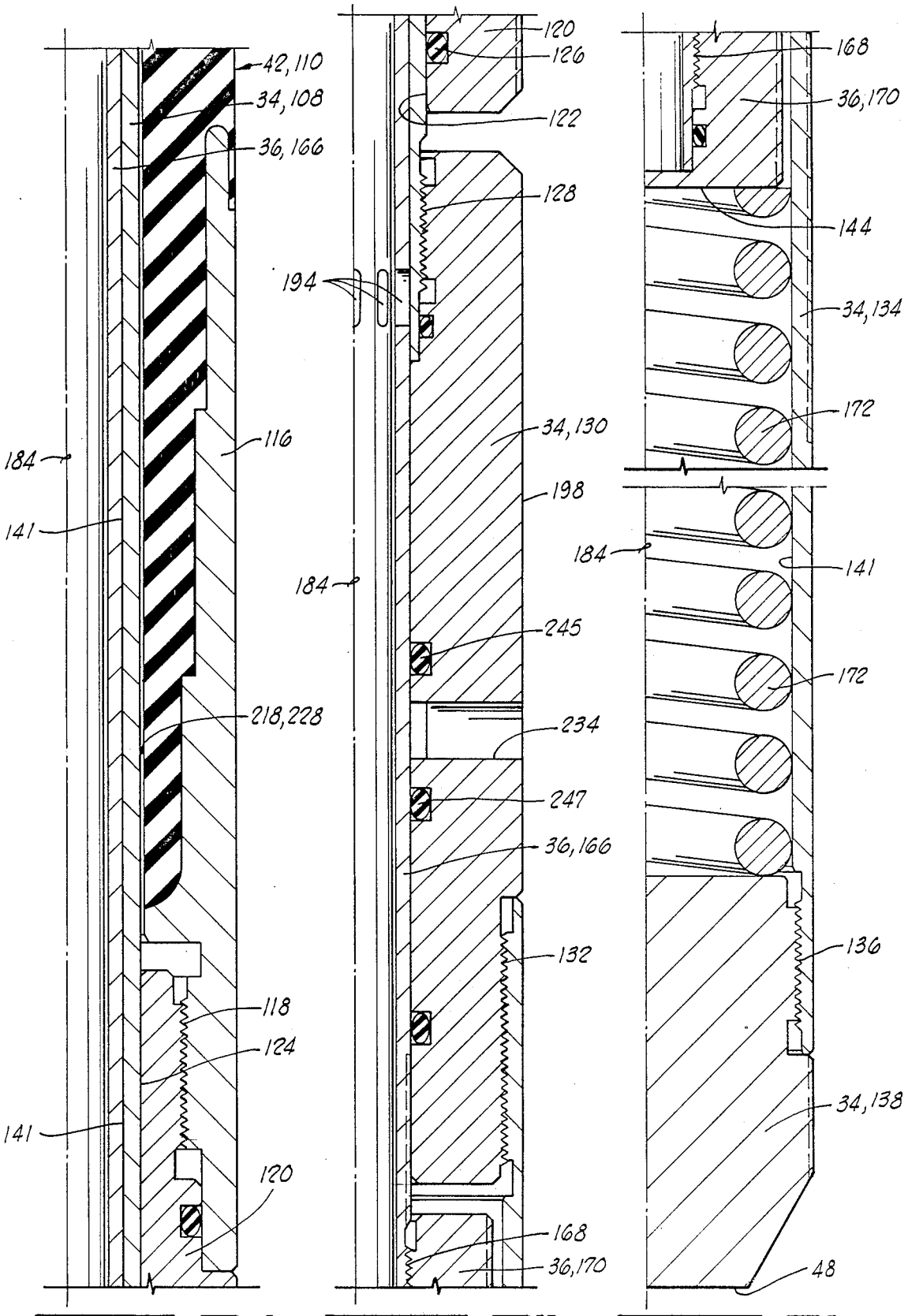

The upper end of mandrel 36 is connected to the releasable connecting means 38 at a threaded connection 252 (see FIG. 3A). The releasable connecting means 38 can be of any one of many available designs. Preferably, it provides a means for releasing the connection in the event the apparatus 10 gets stuck in a well, so that the coiled tubing 32 can be retrieved, and then a fishing line or the like can be utilized to attempt to remove the stuck apparatus 10. The releasable connecting means 38 can be generally referred to as an upper connecting means 38 operably associated with both the mandrel 36 and the housing 34 for connecting the housing 34 to the coiled tubing 32 and for communicating an interior of the housing 34 and of the mandrel 36 with the bore of the coiled tubing 32. Furthermore, the threads 252 on the upper end of mandrel 38 can themselves be generally referred to as an upper connecting means for connecting the mandrel 36 and the housing 34 to the tubing string 32 and for communicating the interior of the housing 34 and of the mandrel 36 with the bore of tubing string 32.

Upper and lower inflatable packers 40 and 42 are mounted on the housing 34. As seen in FIG. 2, the upper and lower inflatable packers 40 and 42 can be inflated to seal against the well casing 14 to isolate a zone 44 of the well.

In a typical well for which the straddle packer apparatus 10 has been designed, such as many of the wells encountered on the North Slope of Alaska, the production tubing 20 is relatively large tubing, typically either three inch or four and one-half inch nominal diameter. The production casing 14 will typically be seven inch nominal diameter casing.

The maximum outside diameter of the straddle packer apparatus 10 for use in such a well is three inches. A straddle packer apparatus 10 of these dimensions can be run down through the production tubing 20 and then its packers 40 and 42 can be inflated to effectively seal against the interior 28 of production casing 14.

Turning now to FIGS. 3A–3L, the details of construction of the straddle packer apparatus 10 will be described.

The housing 34 has an upper end 46 and a lower end 48. Housing 34 is made up of a plurality of connected segments as follows, beginning at the upper end 46 in FIG. 3A.

Housing 34 includes an upper end section 50, threadedly connected at 52 to a bearing housing section 54. A lower end of bearing housing section 54 is threadedly connected at 56 to a splined housing section 58. A lower end of splined housing section 58 is connected at threaded connection 60 to upper equalizing housing section 62.

A lower end of upper equalizing housing section 62 is connected at threaded connection 64 to an upper inflation housing section 66. A lower end of upper inflation housing section 66 is connected at an internal thread 68 to an upper packer housing section 70.

The upper packer 40 includes an elastomeric inflatable element 72 having an annular packer ring 74 at its upper end which is threadedly and thus fixedly connected to upper inflation housing section 66 at threaded connection 76. At its lower end, the packer 40 has a lower ring 78 threadedly connected at 80 to a sliding lower packer shoe 82. The lower packer shoe 82 has an inside bore 84 closely and slidably received on an outer cylindrical surface 86 of upper packer housing section 70 with a sliding O-ring seal 88 provided therebetween.

Continuing with the description of housing 34, the lower end of upper packer housing section 70 is connected at threaded connection 90 to a treating housing section 92. The lower end of treating housing section 92 is connected at threaded connection 94 to a replaceable extension case housing section 96, which is in turn connected at threaded connection 98 to an adapter housing section 100. The adapter housing section 100 is connected at threaded connection 102 to a lower inflation housing section 104, which is in turn connected at internal thread 106 to a lower packer housing section 108.

The lower packer 42 includes an inflatable element 110 having an upper packer ring 112 attached thereto which is threadedly and fixedly connected at threaded connection 114 to the lower inflation housing section 104. The inflatable element 110 has a lower packer ring 116 bonded thereto which is threadedly connected at 118 to a lower annular sliding packer shoe 120. Shoe 120 has a cylindrical inner bore 122 which is closely and slidably received about the cylindrical outer surface 124 of lower packer housing section 108 with a sliding O-ring seal 126 being provided therebetween.

Continuing with the description of housing 34, the lower packer housing section 108 has its lower end threadedly connected at 128 to a lower equalizing housing section 130, which in turn is threadedly connected at 132 to a spring housing section 134. Finally, the spring housing section 134 has its lower end connected at threaded connection 136 to bottom plug section 138.

The upper end section 50 of housing 34 has an inner bore 140 which defines the upper end of a central housing opening generally designated as 141.

The inner mandrel 36 is slidably received within the central housing opening 141. Mandrel 36 has an upper end 142 (see FIG. 3A) and a lower end 144 (see FIG. 3L). The mandrel 36 is made up of several interconnected segments as follows, beginning at upper end 142. Mandrel 36 includes an upper mandrel section 146, threadedly connected at 148 to a splined mandrel coupling 150. Splined mandrel coupling 150 includes a plurality of radially outward extending splines 152 which mesh with a plurality of radially inwardly extending splines 154 of splined housing section 58 so as to prevent rotational motion between mandrel 36 and housing 34.

Splined mandrel coupling 150 is connected at threaded connection 156 to an intermediate mandrel section 158, which in turn has its lower end threadedly connected at 160 to a replaceable mandrel extension coupling 162. The replaceable mandrel extension coupling 162 is connected at threaded connection 164 to a lower mandrel section 166 which is connected at threaded connection 168 to a mandrel bottom cap 170.

A spring biasing means 172, which is a coiled compression spring, is located within spring housing section 134 and held between the mandrel bottom cap 170 and the bottom housing plug section 138 for biasing the mandrel 36 telescopingly outward, i.e., upward in FIGS. 3A–3L, relative to the housing 34.

Figure 5G:
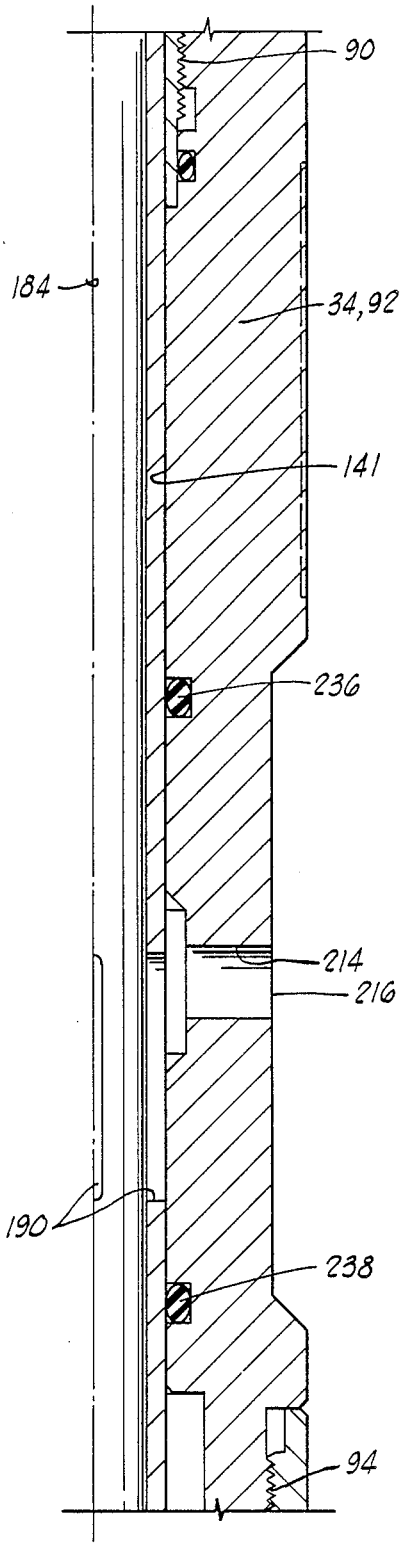
FIGS. 5A–5G comprise an elevation right side only view of an upper portion of the apparatus of FIG. 3, and correspond generally to FIGS. 3A–3G.
Figure 4:
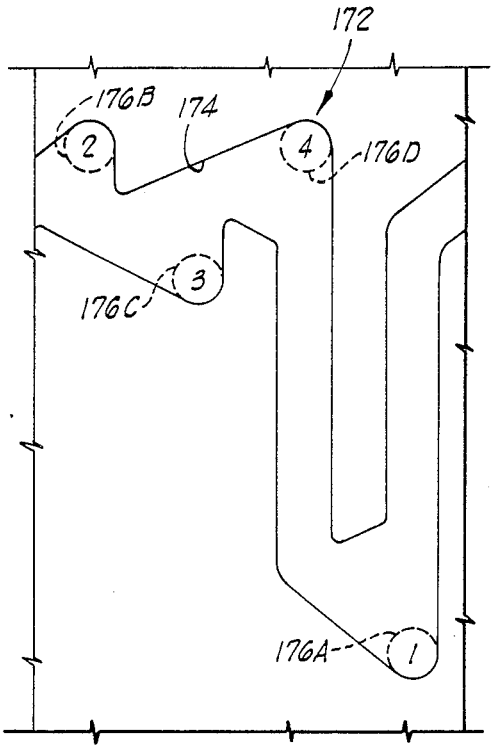
FIG. 4 is a laid-out view of the endless J-slot, with the repetitive pattern of positions of the lug within the J-slot being shown in dashed circles.
Figures 5A, 5B, 5C:
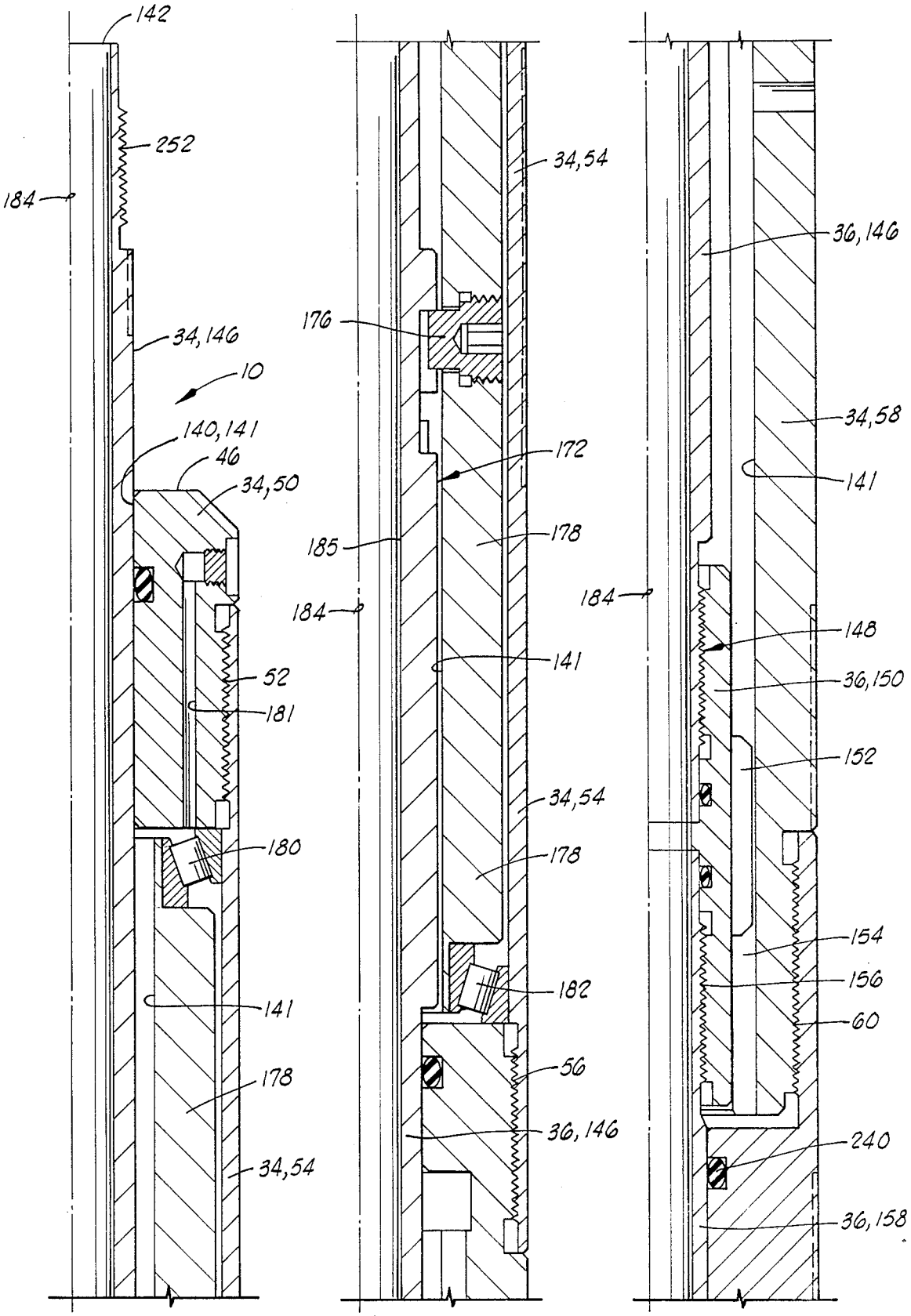
Figures 5D, 5E, 5F:
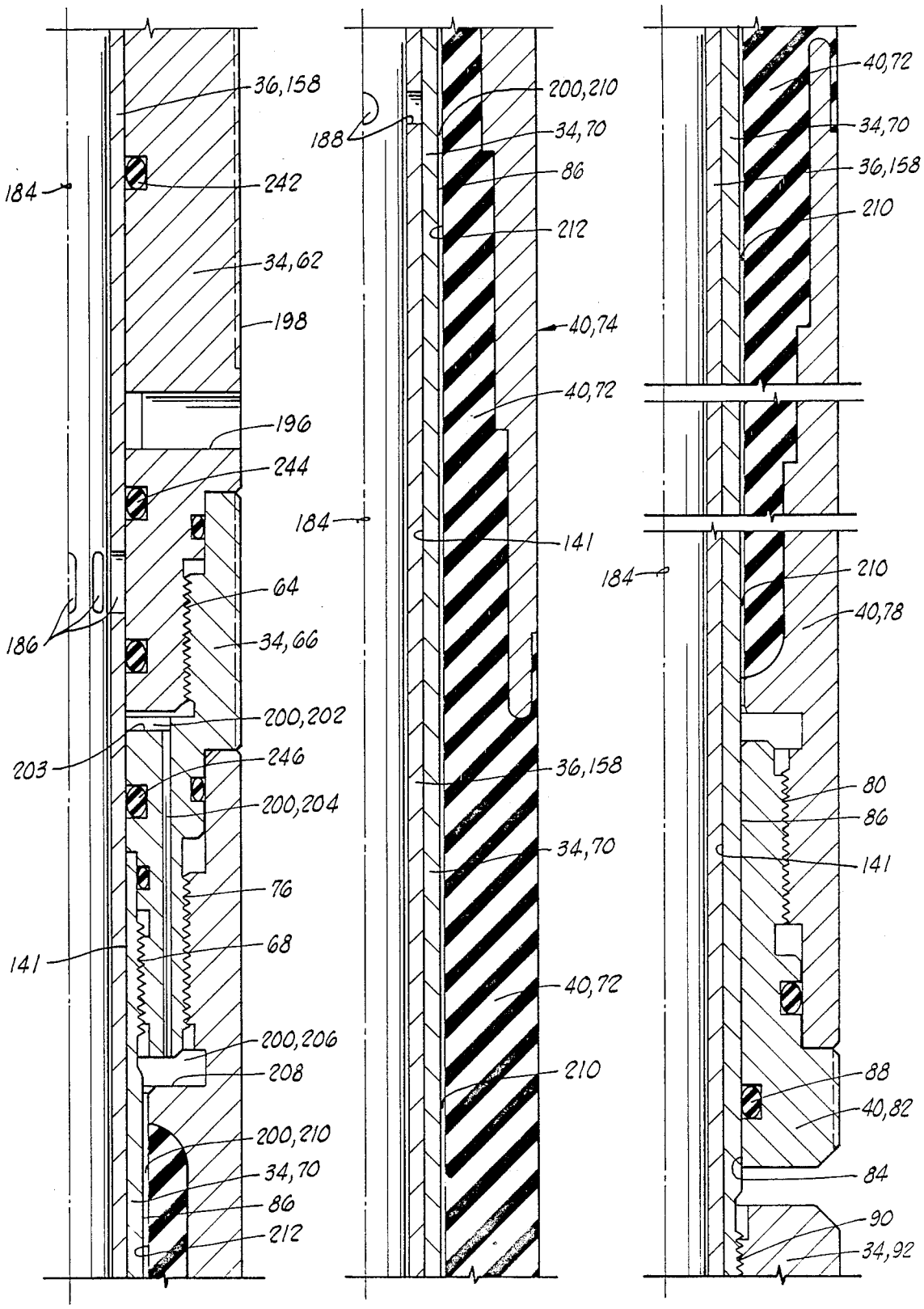
Figures 6A, 6B, 6C:
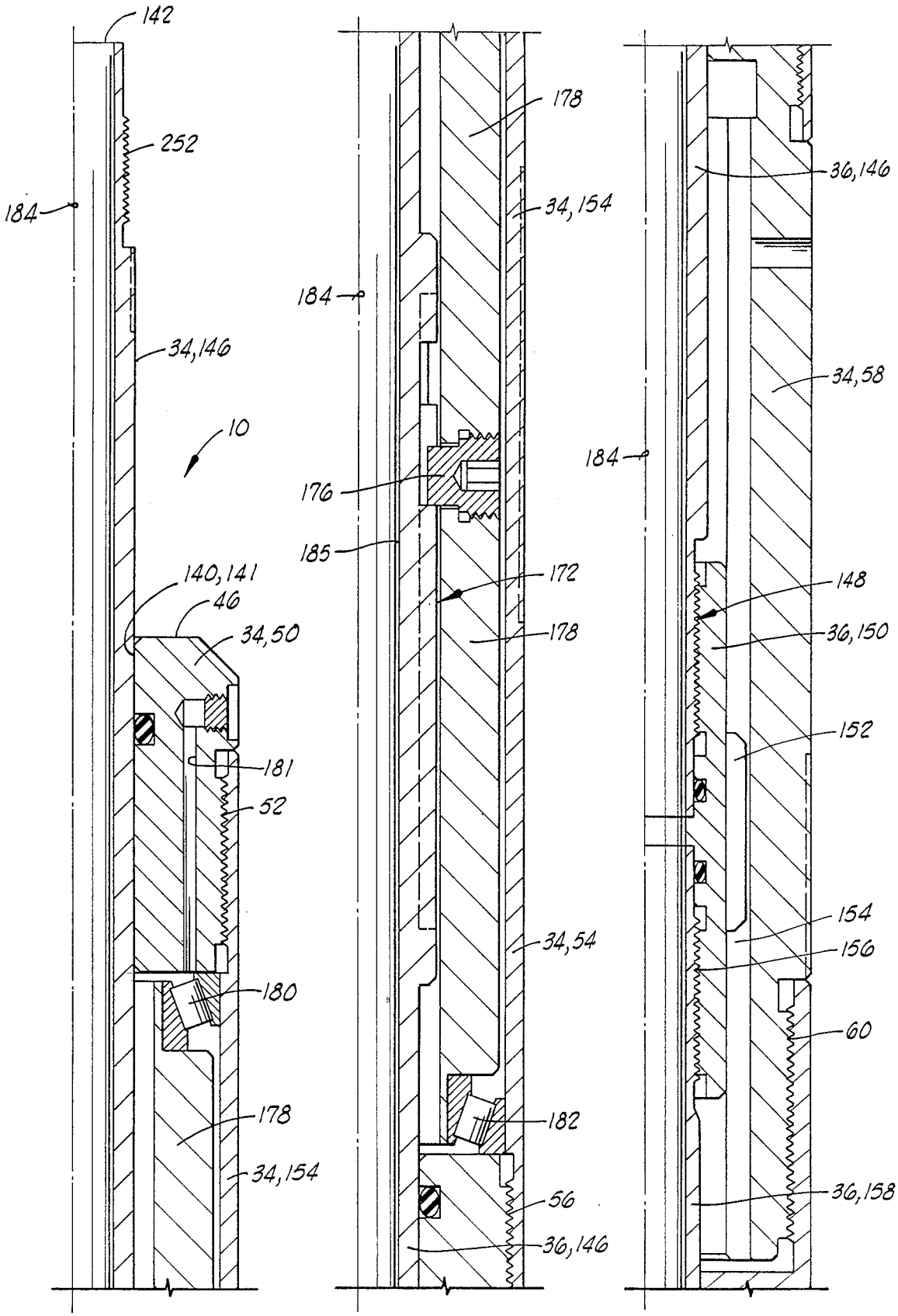
FIGS. 6A–6F comprise an elevation right side only sectioned view of the apparatus of FIG. 3 and generally correspond to those portions of the tool shown in FIGS. 3A–3G.
Figures 6D, 6E, 6F:
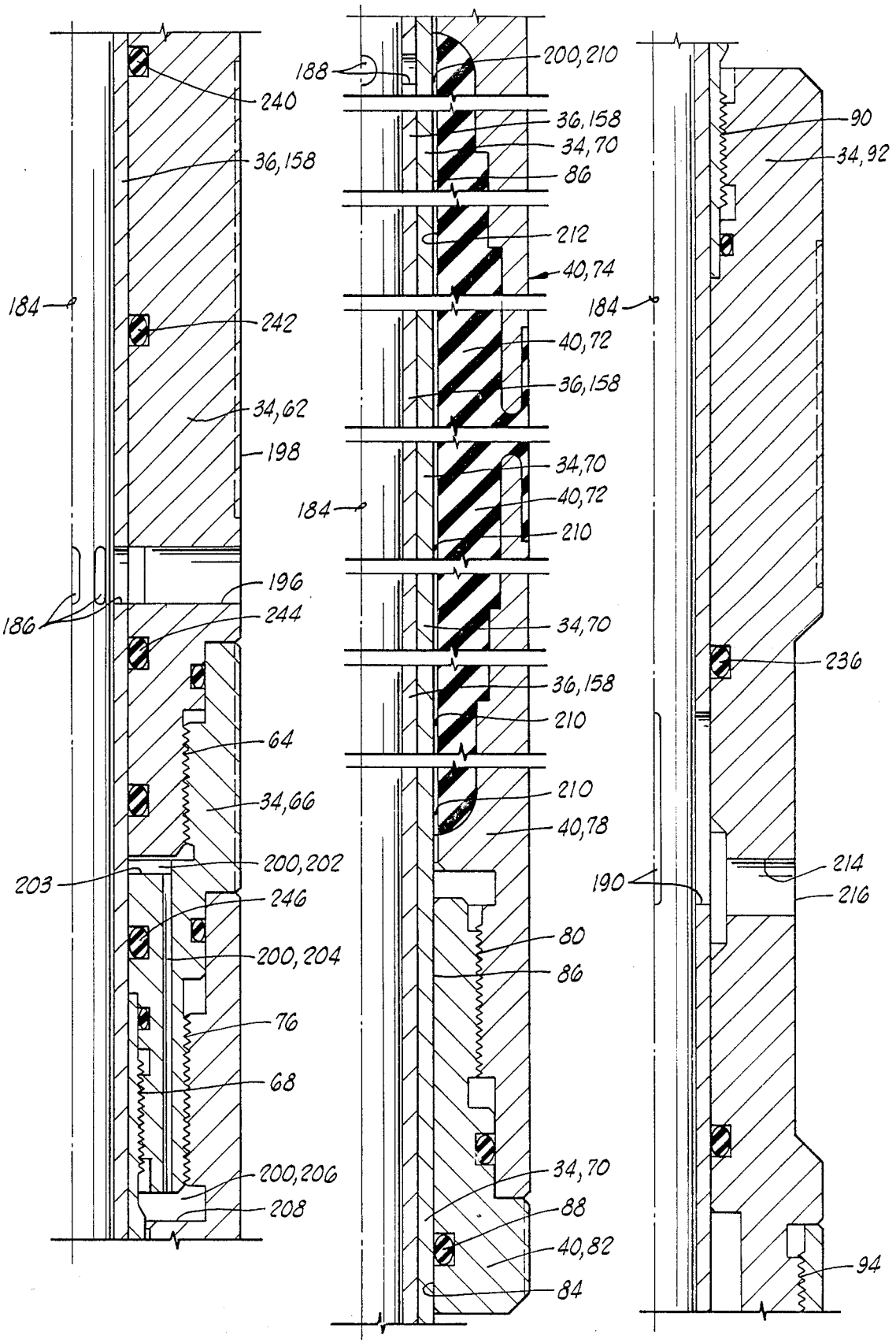

As is seen in FIGS. 3, 5 and 6, the mandrel 36 telescopes between several positions relative to the housing 34. This telescoping movement of mandrel 36 relative to housing 34 is controlled by a lug and endless J-slot means generally designated by the numeral 172 (see FIGS. 3B, 4, 5B and 6B) which is operably associated with the housing 34 and inner mandrel 36 for controlling a telescoping position of the mandrel 36 relative to the housing 34 in response to telescoping reciprocation without rotation of the mandrel 36 relative to the housing 34. The lug and J-slot means 172 includes an endless J-slot 174 defined in the upper mandrel section 146, and includes a lug 176 carried by the housing 34 and received in the slot 174 to define an endlessly repeating pattern of telescopingly reciprocating movement of the mandrel 36 relative to the housing 34.

The lug 176 is defined on a rotating body 178 which is rotatingly mounted in upper and lower bearings 180 and 182 within the bearing housing section 54 of housing 34. Thus, as the mandrel 36 reciprocates relative to the housing 34, the rotating body 178 and its attached lug 176 can freely rotate about a longitudinal axis 184 of housing 34 without having relative rotational motion between the mandrel 36 and housing 34. As previously indicated, the mandrel 36 and housing 34 are splined together by splines 152 and 154, thus preventing any rotational motion between the mandrel 36 and housing 34. A lubricating passage 181 is defined in upper housing section 50 for lubricating bearings 180 and 182.

The spacing between upper and lower packers 40 and 42 is defined by the dimensions of the housing 34 upon which they are mounted. This spacing can be adjusted by removing replaceable mandrel extension coupling 162 of mandrel 36 and the replaceable extension case housing section 96 of housing 34 and replacing them with analogous items of different lengths with similar upper and lower end connections.

The housing 34 has a plurality of passages defined therethrough, and the mandrel 36 has a plurality of ports defined therethrough communicating with a mandrel bore 185. The various operating positions of the straddle packer apparatus 10, as defined by the lug and endless J-slot means 172, serve to appropriately align the various ports of mandrel 36 with the various passages of housing 34 to provide the desired functions from the straddle packer apparatus 10. These various ports and passages will first be identified, and then the various operating positions of the straddle packer apparatus 10 can be accurately described.

The various ports in the mandrel 36 will first be described, starting from its upper end 142.

The intermediate mandrel section 158 has a plurality of upper equalizing ports 186 (see FIG. 3D) defined therethrough. A short distance below the upper equalizing ports 186, a plurality of upper inflation ports 188 (see FIG. 3E) are found. Near the lower end of intermediate mandrel section 158, a plurality of treating ports 190 (see FIG. 3G) are defined.

The lower mandrel section 166 includes a plurality of lower inflation ports 192 (see FIG. 3I) defined therethrough. Near the lower end of lower mandrel section 166, there are a plurality of lower equalizing ports 194 (see FIG. 3K).

The upper and lower equalizing ports 186 and 194 can be jointly referred to as an equalizing port means 186, 194. The upper and lower inflation ports 188 and 192 can be jointly referred to as an inflation port means 188, 192.

Turning now to the various passages defined within the housing 34, an upper equalizing passage 196 (see FIG. 3D) is defined through upper equalizing housing section 62 and communicates with an exterior surface 198 of the housing 34 above upper packer 40. There are in fact a plurality of radially oriented upper equalizing passages 196 spaced around the circumference of upper equalizing housing section 62.

An upper inflation passage 200 (see FIG. 3E) begins with an annular space 202 defined between the lower end of upper equalizing housing section 62 and an upward facing shoulder 203 of upper inflation housing section 66. Upper inflation passage 200 continues with a plurality of longitudinal bores 204, only one of which is visible in FIG. 3E, extending to the lower end of upper inflation housing section 66. The longitudinal bores 204 communicate with an annular space 206 defined between the lower end of upper inflation housing section 66 and an upward facing shoulder 208 of upper packer ring 74 of upper inflatable packer 40. The upper inflation passage 200 finally includes a long thin annular space 210 defined between the outer surface 86 of upper packer housing section 70 and an inside diameter 212 of the inflatable element 72 of upper packer 40. The lower end of upper inflation passage 200 is defined by the sliding seal 88 which seals between lower packer shoe 82 and upper packer housing section 70.

A treating fluid passage 214 (see FIG. 3G) is defined as a substantially radial bore through the wall of treating housing section 92 and has an outlet 216. There are in fact a plurality of such radially extending treating fluid passages 214 distributed around the circumference of treating housing section 92.

The housing 34 also has a lower inflation passage 218 (see FIG. 3I) defined therein. Lower inflation passage 218 begins with an annular space 220 defined between the lower end of adapter housing section 100 and an upward facing shoulder 222 of lower inflation housing section 104. Lower inflation passage 218 continues with a plurality of longitudinal bores 224 extending downward through lower inflation housing section 104 to a lower end thereof where they are communicated with an annular space 226 which in turn communicates with a long thin annular space 228. The annular space 228 is defined between an outer surface 230 of lower packer housing section 108, and an inside diameter 232 of the inflatable element 110 of lower packer 42. The lower extremity of lower inflation passage 218 is defined by the sliding seal 126 which seals between lower packer shoe 120 and the lower packer housing section 108.

Finally, the lower equalizing housing section 130 of housing 34 has a lower equalizing passage 234 (see FIG. 3K) defined therethrough. There are in fact a plurality of such lower equalizing passages 234 spaced around the circumference of the lower equalizing housing section 130. Passages 234 communicate with the exterior 198 of housing 34 below lower packer 42.

The upper inflation passage 200 and the lower inflation passage 218 can be jointly referred to as an inflation passage means 200, 218 defined in the housing 34.

The upper equalizing passages 196 and the lower equalizing passages 234 can be jointly referred to as an equalizing passage means 196, 234 defined in the housing 34.

The straddle packer apparatus 10 is shown in FIGS. 3A–3L in an inflating position wherein the upper and lower inflation ports 188 and 192 of mandrel 36 are communicated with the upper and lower inflation passages 200 and 218 of housing 34, so that inflation fluid can be pumped down through the coiled tubing 32, and through the mandrel bore 186 then through the inflation ports 188 and 192 and through the inflation passages 200 and 218 to inflate the packers 40 and 42 as schematically illustrated in FIG. 2.

In the inflating position of the straddle packer apparatus 10 as shown in FIGS. 3A–3L, the treating ports 190 of mandrel 36 are isolated from the treating fluid passages 214 of housing 34 by O-rings 236 and 238.

Also, in the inflating position, the upper equalizing passages 196 are isolated from the upper equalizing ports 186 by O-rings 240, 242 and 244 and the lower equalizing passages 234 are isolated from the lower equalizing ports 194 by O-rings 245 and 247.

The inflating position of straddle packer apparatus 10 is defined by the lug and J-slot means 172 by position 176A of lug 176 seen in FIG. 4. In this inflating position, the mandrel 36 is in its telescopingly extendedmost position relative to housing 34, which is maintained by the biasing force of spring 172 as the apparatus 10 is run into the well 12, to prevent premature telescoping collapse of the mandrel 36 within the housing 34.

The straddle packer apparatus 10 is run into the well 12 in the inflating position of FIGS. 3A–3L. After the apparatus 10 has been positioned as illustrated in FIG. 1, inflation fluid is pumped down the coiled tubing 32 to inflate the packers 40 and 42 as shown in FIG. 2. Once the packers 40 and 42 are inflated, the housing 34 is anchored in place relative to the well 12, and any further reciprocation of the coiled tubing 32 will act to reciprocate the mandrel 36 within the housing 34 as permitted by the lug and J-slot means 172.

After the packers 40 and 42 have been inflated as shown in FIG. 2, weight is set down on the apparatus 10 by slacking off on the coiled tubing 32 thus telescoping the mandrel 36 downward into the housing 34 until the lug 176 reaches position 176B as seen in FIG. 4 and corresponding to FIGS. 5A–5G. In FIGS. 5A–5G, the apparatus 10 is shown in the treating position, which as further described below is also identical to a ready position.

As the mandrel 36 moves downward from the inflating position of FIGS. 3A–3L toward the treating position of FIGS. 5A–5G, the upper and lower inflation ports 188 and 192 are first isolated from the upper and lower inflation passages 200 and 218 as the inflation ports 188 and 192 move below O-ring seals 246 and 248, respectively. Then, with continued downward movement of mandrel 36, the treating ports 190 thereof are moved below O-ring 236 and into communication with the treating fluid passages 214 of housing 34.

In the treating position of FIGS. 5A–5G, the upper equalizing ports 186 are isolated from the upper equalizing passages 196 by O-ring 244. Although not shown in FIGS. 5A–5G, the lower equalizing ports 194 are isolated from lower equalizing passages 234 by O-ring 247 (see FIG. 3K).

When the straddle packer apparatus 10 is in the treating position of FIGS. 5A–5G, treating fluid is pumped down the coiled tubing 32 and through the mandrel 36 out the treating ports 190 and through the treating fluid passages 214 into the isolated zone 44 defined between the upper and lower packers 40 and 42. The treating fluid can be squeezed through the perforations 30 into the formation 26 to treat that formation.

After the treating operation is completed, weight is picked up from the apparatus 10 by picking up on the coiled tubing 32 and the mandrel 36 moves upward a relatively small distance until the lug 176 reaches position 176C as shown in FIG. 4 and FIGS. 6A–6F. The position of FIGS. 6A–6F is an equalizing position, where the isolated zone 44 remains in communication with the mandrel bore 185 through the treating fluid passages 214 and treating fluid ports 190 which are still in communication therewith. Also, an annulus 252 (see FIG. 2) of the well 12 defined between the tubing string 32 and well casing 14 above the upper packer 40, and the interior 28 of the production casing 14 below the lower packer 42 are communicated with the mandrel bore 185 through the upper and lower equalizing passages 196 and 234 which are aligned with the upper and lower equalizing ports 186 and 194, respectively, of mandrel 36.

In FIGS. 6A–6F, the alignment of the upper equalizing passages 196 with upper equalizing ports 186 is illustrated as is the continued alignment of the treating fluid passages 214 with the treating fluid ports 190.

With the straddle packer apparatus 10 in the equalizing position of FIGS. 6A–6F, fluid pressure from the isolated zone 44 is allowed to equalize with fluid pressure in the annulus 252 above upper packer 40 and in the interior 28 of production casing 14 below the lower packer 42, so as to eliminate any substantial differential pressures across the upper and lower inflatable packers 40 and 42. The purpose of this is to avoid damage to the upper and lower inflatable packers 40 and 42 as they are subsequently deflated and moved to another position, in order to allow them to be reused a number of times without removing the apparatus 10 from a well.

After sufficient time has passed to allow pressures across the packers 40 and 42 to equalize, the coiled tubing 32 is again lowered to set down weight on the apparatus 10 and index the lug 176 to position 176D of FIG. 4, which is referred to as a ready position. The telescoping position of mandrel 36 relative to housing 34 in the ready position represented by lug position 176D is in fact identical to the telescoping position of mandrel 36 relative to housing 34 in the treating position represented by lug position 176B, and thus FIGS. 5A–5G illustrate the ready position of straddle packer apparatus 10, in addition to illustrating the treating position.

Then, to deflate the inflatable packers 40 and 42, weight is again picked up from the apparatus 10 by lifting on the coiled tubing 32 thus returning the lug 176 to a position within endless slot 174 corresponding to its initial position 176A, thus returning the straddle packer apparatus 10 to the relative position shown in FIGS. 3A–3L thus bringing the inflation ports 188 and 192 back into communication with the inflation passages 200 and 218 thus allowing inflation fluid contained in the inflatable packers 40 and 42 to be relieved into the mandrel bore 185 thus deflating the packers 140 and 142.

Then, the straddle packer apparatus 10 can be relocated to another position within the well 12 and the cycle can be repeated to again inflate the packers and treat another isolated zone of the well 12.

Referring to FIG. 4, a laid-out view is thereshown of the endless J-slot 174 of mandrel 36, with the four positions of lug 176 being shown in dashed lines and designated as 176A–176D as previously described.

Thus, the lug and endless J-slot means 172 defines an endlessly repeating pattern of telescopingly reciprocating movement of the mandrel 36 relative to the housing 34. It can be further characterized as defining a repeating pattern of positions of mandrel 36 relative to the housing 34, said pattern including a sequence of inflating position as seen in FIGS. 3A–3L, treating position as seen in FIGS. 5A–5G, equalizing position as seen in FIGS. 6A–6F, and ready position as seen in FIGS. 5A–5G wherein the next telescoping stroke of the mandrel 36 relative to the housing 34 will return the apparatus 10 to the inflating position of FIGS. 3A–3L.

In general terms, the mandrel 36 and the lug and endless J-slot means 172 can be jointly referred to as a control means 36, 172 operably associated with the housing 34 for defining a plurality of operating positions of the straddle packer apparatus 10. The mandrel bore 185 of that portion of mandrel 36 contained within the housing 34 can also be generally referred to as defining at least a portion of the interior of the housing 34.

The present invention also encompasses methods of utilizing the apparatus just described.

A method of treating the subsurface zone 26 of well 12 having the well casing 14 with the production tubing 20 in place within the casing 14 can be described as follows.

First, a straddle packer apparatus 10 having upper and lower inflatable packers 40 and 42 with a treating fluid passage outlet 216 located therebetween is provided.

The straddle packer apparatus 10 is lowered on a working tubing, preferably coiled tubing 32, down through production tubing 20 to a position below the lower end 24 of production tubing 20. The straddle packer apparatus 10 is placed adjacent the subsurface zone 26 which is to be treated as shown in FIG. 1.

Then inflation fluid is pumped down through the bore of the coiled tubing 32 thereby inflating the upper and lower packers 40 and 42 as shown in FIG. 2 to seal the packers 40 and 42 against the production casing 14 to isolate a zone 44 of the well corresponding to and in communication with the subsurface formation 26.

Weight is then set down on the straddle packer apparatus 10 with the coiled tubing 32 without rotating the coiled tubing 32, thus moving the straddle packer apparatus 10 to the treating position of FIGS. 5A–5G and trapping the inflation fluid in the inflatable packers 40 and 42 and placing the treating fluid passage outlet 216 of the straddle packer apparatus 10 in communication with the bore of the coiled tubing 32.

Then treating fluid is pumped down through the bore of the coiled tubing 32 to treat the isolated zone 40 and thus the subsurface formation 26 of the well 12.

Then weight is picked up from the straddle packer apparatus 10 with the coiled tubing 32 without rotating the coiled tubing 32 to communicate the isolated zone 44 of the well 12 through the straddle packer apparatus 10 with the annulus 252 above upper packer 40 and with the interior 28 of casing 14 below the lower packer 42 thus equalizing pressure across the inflated packers 40 and 42 prior to deflation of the same.

Subsequently, weight is again set down on the apparatus 10 with the coiled tubing 32 to index the lug to the ready position 176D, and weight is then again picked up with the coiled tubing 32 to return the apparatus 10 to the inflating position of FIGS. 3A–3L thus communicating the inflation passages of the housing 34 with the bore of the coiled tubing 32 and thereby deflating the upper and lower packers 40 and 42 to unseat the packers from the production casing 22.

The apparatus 10 can then be relocated to another position within the well 12 and the cycle repeated to treat another zone of the well.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A straddle packer apparatus, comprising:

a housing having a central housing opening, and having packer inflation passage means defined in said housing, and having a treating fluid passage defined in said housing with an outlet of said treating fluid passage communicating with an exterior of said housing;

upper and lower longitudinally spaced packers mounted on said housing on opposite sides of said outlet of said treating fluid passage, said packers being in communication with said packer inflation passage means;

an inner mandrel slidably received in said central housing opening, said mandrel having a mandrel bore and having an inflation port means and a treating port means each communicated with said mandrel bore; and lug and endless J-slot means, operably associated with said housing and said inner mandrel, for controlling a telescoping position of said mandrel relative to said housing in response to telescoping reciprocation without rotation of said mandrel relative to said housing, said mandrel being movable between an inflating position wherein said inflation port means of said mandrel is communicated with said inflation passage means of said housing and said treating port means of said mandrel is isolated from said treating fluid passage of said housing, and a treating position wherein said inflation port means of said mandrel is isolated from said inflation passage means of said housing and said treating port means of said mandrel is communicated with said treating fluid passage of said housing.

2. The apparatus of claim 1, further comprising:

spring biasing means, operably associated with said housing and said mandrel, for biasing said mandrel telescopingly outward relative to said housing.

3. The apparatus of claim 1, wherein said lug and endless J-slot means comprises:

a slot means defined on and longitudinally movable with one of said housing and said mandrel;

a lug means defined on and longitudinally movable with the other of said housing and said mandrel, said lug means being received in said slot means to define an endlessly repeating pattern of telescopingly reciprocating movement of said mandrel relative to said housing; and one of said slot means and said lug means being defined on a rotating body rotatingly mounted on a respective one of said mandrel and said housing to permit relative rotational motion between said slot means and said lug means about a longitudinal axis of said housing without having relative rotational motion between said mandrel and said housing.

4. The apparatus of claim 3, wherein:

said slot means is defined on said mandrel.

5. The apparatus of claim 1, wherein:

said inflation passage means includes separate upper and lower inflation passages defined in said housing and communicated with said upper and lower packers, respectively; and said inflation port means includes separate upper and lower inflation ports arranged to communicate said mandrel bore with said upper and lower inflation passages, respectively, when said mandrel is in said inflating position.

6. The apparatus of claim 1, wherein:

said housing has an equalizing passage means defined therein communicated with the exterior of said housing above said upper packer and communicated with the exterior of said housing below said lower packer;

said mandrel has an equalizing port means defined therein communicated with said mandrel bore; and said lug and endless J-slot means further defines an equalizing position of said mandrel wherein said equalizing port means of said mandrel communicates said equalizing passage means of said housing with said mandrel bore while said treating fluid passage is also communicated with said mandrel bore through said treating port means.

7. The apparatus of claim 6, wherein:

said lug and endless J-slot means is further characterized as defining a repeating pattern of positions of said mandrel relative to said housing, said pattern including a repetitive sequence of inflating position, treating position, equalizing position and ready position, wherein said ready position is such that upon the next telescoping stroke of said mandrel relative to said housing said mandrel returns to said inflating position.

8. The apparatus of claim 7, wherein:

said lug and endless J-slot means is further characterized in that said mandrel telescopes inward from said inflating position to said treating position, then outward to said equalizing position, then inward to said ready position, then outward to said inflating position.

9. The apparatus of claim 7, wherein:

the telescoping position of said mandrel relative to said housing in said treating position is substantially identical to the telescoping position of said mandrel relative to said housing in said ready position.

10. A straddle packer apparatus constructed for use with a tubing string having a tubing bore, said apparatus comprising:

upper and lower longitudinally spaced inflatable packers;

a housing having an interior and having said packers mounted on said housing, and said housing further including:

inflation passage means defined therein communicated with said upper and lower inflatable packers;

treating fluid passage means defined therein and having a treating fluid outlet communicated with an exterior of said housing between said upper and lower inflatable packers; and equalizing passage means defined therein communicated with said exterior of said housing on a side of at least one of said upper and lower inflatable packers opposite from said treating fluid outlet;

upper connecting means, operably associated with said housing, for connecting said housing to said tubing string and for communicating said interior of said housing with said tubing bore; and control means, operably associated with said housing, for defining a plurality of operating positions of said apparatus including:

an inflating position wherein said inflation passage means is communicated with said tubing bore, and said treating passage means and said equalizing passage means are both isolated from said tubing bore;

a treating position wherein said treating fluid passage means is communicated with said tubing bore and said inflation passage means and equalizing passage means are both isolated from said tubing bore; and an equalizing position wherein said equalizing passage means is communicated with said treating fluid passage means and said inflation passage means is isolated from said tubing bore.

11. The apparatus of claim 10, wherein:

said control means includes an inner mandrel slidably received in said housing, said mandrel having a mandrel bore communicated by said upper connecting means with said tubing bore, said mandrel bore defining at least a portion of said housing interior, said mandrel further including:

inflation port means defined in said mandrel for communicating said inflation passage means with said mandrel bore and thus with said tubing bore when said apparatus is in said inflating position;

treating port means defined in said mandrel for communicating said treating passage means with said mandrel bore and thus with said tubing bore when said apparatus is in said treating position; and equalizing port means defined in said mandrel for communicating said equalizing passage means with said tubing bore and with said treating passage means through said treating port means when said apparatus is in said equalizing position.

12. The apparatus of claim 11, wherein:

said inflation passage means includes separate upper and lower inflation passages defined in said housing and communicated with said upper and lower inflatable packers, respectively; and said inflation port means includes separate upper and lower inflation ports defined in said mandrel and positioned to simultaneously communicate said upper and lower inflation passages with said mandrel bore when said apparatus is in its said inflating position.

13. The apparatus of claim 11, wherein:

said equalizing passage means includes separate upper and lower equalizing passages defined in said housing and communicated with said exterior of said housing above said upper packer and below said lower packer, respectively; and said equalizing port means includes separate upper and lower equalizing ports defined in said mandrel and positioned to simultaneously communicate said upper and lower equalizing passages with said mandrel bore when said apparatus is in its said equalizing position.

14. The apparatus of claim 11, wherein:

said control means further includes lug and J-slot means, operably associated with said housing and said mandrel, for controlling a telescoping position of said mandrel relative to said housing in response to telescoping reciprocation of said mandrel relative to said housing.

15. The apparatus of claim 14, wherein said lug and J-slot means comprises:

a slot means defined on and longitudinally movable with one of said housing and said mandrel;

a lug means defined on and longitudinally movable with the other of said housing and said mandrel, said lug means being received in said slot means to define an endlessly repeating pattern of telescopingly reciprocating movement of said mandrel relative to said housing; and one of said slot means and said lug means being defined on a rotating body rotatingly mounted on a respective one of said mandrel and said housing to permit relative rotational motion between said slot means and said lug means about a longitudinal axis of said housing without having relative rotational motion between said mandrel and said housing.

16. The apparatus of claim 15, wherein:

said lug and J-slot means is further characterized as defining a repeating pattern of positions of said mandrel relative to said housing, said pattern including a repetitive sequence of inflating position, treating position, equalizing position, and ready position, wherein said ready position is such that upon the next telescoping stroke of said mandrel relative to said housing said mandrel returns to said inflating position.

17. The apparatus of claim 16, wherein:

said lug and J-slot means is further characterized in that said mandrel telescopes inward from said inflating position to said treating position, then outward to said equalizing position, then inward to said ready position, then outward to said inflating position.

18. The apparatus of claim 11, wherein:

said inner mandrel includes first and second mandrel portions joined by a replaceable mandrel connector;

said housing includes first and second housing portions joined by a replaceable housing connector; and said mandrel and said housing are so arranged and constructed that a longitudinal spacing between said upper and lower packers can be adjusted by replacing said replaceable mandrel connector and said replaceable housing connector with substitute connectors of different lengths.

19. A method of treating a subsurface zone of a well having a well casing with a production tubing string in place in said casing, said method comprising the steps of:

(a) providing a straddle packer apparatus having upper and lower inflatable packers with a treating fluid passage outlet located between said packers, said packers each having a flexible packer element defining an inflation cavity so that the packers can be inflated by inflation fluid contained in said cavities and acting directly against said flexible packer elements;

(b) lowering said straddle packer apparatus on a working tubing down through and below a lower end of said production tubing;

(c) placing said straddle packer apparatus adjacent said subsurface zone;

(d) pumping inflation fluid down through a bore of said working tubing into said inflation cavities and thereby inflating said upper and lower packers to seal said packers against said casing and isolate said zone of said well;

(e) setting down weight on said straddle packer apparatus with said working tubing, without rotating said working tubing, and thereby trapping said inflation fluid in said inflatable packers and placing said treating fluid passage outlet of said straddle packer apparatus in communication with said bore of said working tubing;

(f) pumping treating fluid down through said bore of said working tubing to treat said isolated zone of said well; and (g) picking up weight from said straddle packer apparatus with said working tubing, without rotating said working tubing, to communicate said isolated zone of said well through said straddle packer apparatus with an interior of said casing outside of said isolated zone thereby equalizing pressure between said isolated zone and said interior of said casing while said packers are still inflated.

20. The method of claim 19, further comprising:

(h) after step (g), setting down weight and then again picking up weight to communicate an inflation passage of said straddle packer apparatus with said bore of said working tubing and thereby deflating said upper and lower packers to unseat said packers from said casing; and then repeating steps (c) through (f) to treat a second zone of said well without removing said straddle packer apparatus from said well.

21. The method of claim 19, wherein:

said step (g) is further characterized in that said isolated zone is communicated with said interior of said casing both above said upper packer and below said lower packer.

* * * * *